US008388358B2

(12) United States Patent
Thompson et al.

(10) Patent No.: US 8,388,358 B2
(45) Date of Patent: Mar. 5, 2013

(54) CONTACT RAIL FOR A JUNCTION BOX

(75) Inventors: Kyle D. Thompson, Lancaster, PA (US); Michael K. Streckewald, Harrisburg, PA (US); Brian J. Williams, York, PA (US); Richard L. Oskowis, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 142 days.

(21) Appl. No.: 12/892,732

(22) Filed: Sep. 28, 2010

(65) Prior Publication Data

US 2012/0077392 A1 Mar. 29, 2012

(51) Int. Cl.
*H01R 12/00* (2006.01)
*H01R 4/48* (2006.01)

(52) U.S. Cl. ..... 439/76.1; 439/828; 439/835

(58) Field of Classification Search ..... 439/76.1, 439/535, 441, 835; 174/50
See application file for complete search history.

(56) References Cited

U.S. PATENT DOCUMENTS 4,460,232 A * 7/1984 Sotolongo ..... 439/535
6,307,144 B1 * 10/2001 Mimura et al. ..... 136/244
6,828,503 B2 * 12/2004 Yoshikawa et al. ..... 174/50
7,097,516 B2 * 8/2006 Werner et al. ..... 439/709
7,134,883 B2 * 11/2006 Werner et al. ..... 439/76.1
7,285,006 B1 * 10/2007 Daily et al. ..... 439/441
7,510,448 B2 * 3/2009 Eppe et al. ..... 439/835
7,530,837 B2 * 5/2009 Nieleck et al. ..... 439/441
7,530,858 B2 * 5/2009 Ma et al. ..... 439/817
7,618,265 B2 * 11/2009 Rueggen et al. ..... 439/76.1
7,648,403 B2 * 1/2010 Rueggen et al. ..... 439/828
7,723,608 B2 * 5/2010 Higashikozono et al. .... 136/244
7,737,355 B2 * 6/2010 Nieleck et al. ..... 136/243
7,824,190 B2 * 11/2010 Beck et al. ..... 439/76.1
7,833,033 B2 * 11/2010 McMahon et al. ..... 439/212
8,003,885 B2 * 8/2011 Richter et al. ..... 174/50
8,075,326 B2 * 12/2011 Quiter et al. ..... 439/224
8,083,540 B1 * 12/2011 Spicer et al. ..... 439/460
8,128,439 B2 * 3/2012 Feldmeier et al. ..... 439/709
8,137,115 B1 * 3/2012 Chou et al. ..... 439/76.1
8,152,536 B2 * 4/2012 Scherer et al. ..... 439/76.1
8,162,677 B2 * 4/2012 Yu et al. ..... 439/76.2
8,203,075 B2 * 6/2012 Wanqin et al. ..... 174/50
8,222,533 B2 * 7/2012 Gherardini et al. ..... 174/260
8,227,942 B2 * 7/2012 Marroquin et al. ..... 307/147
8,248,804 B2 * 8/2012 Han et al. ..... 361/717
2005/0268958 A1 * 12/2005 Aoyama ..... 136/244
2008/0253092 A1 * 10/2008 Duesterhoeft et al. ..... 361/710
2009/0084570 A1 * 4/2009 Gherardini et al. ..... 174/51
2009/0272559 A1 * 11/2009 Richter et al. ..... 174/59
2010/0012343 A1 * 1/2010 Ji et al. ..... 174/50.52
2010/0297860 A1 * 11/2010 Shmukler et al. ..... 439/110

(Continued)

FOREIGN PATENT DOCUMENTS

DE 102004020958 * 8/2005

*Primary Examiner* — Neil Abrams

(57) ABSTRACT

A contact rail is provided including a module coupling end and a mating end. A diode mounting surface is positioned between the module coupling end and the mating end. A pivot member extends from a base of the module coupling end. The pivot member is configured to be engaged by an elongated tool. A module coupling fastener engages the base of the module coupling end. The elongated tool is configured to engage the module coupling fastener. The elongated tool is configured to pivot about the pivot member to separate the module coupling fastener from the base of the module coupling end so that a contact from a power module is receivable between the base of the module coupling end and the module coupling fastener.

18 Claims, 6 Drawing Sheets

U.S. PATENT DOCUMENTS

2011/0240088 A1* 10/2011 Ecob ..... 136/244
2011/0269347 A1* 11/2011 Ackermann et al. ..... 439/626
2012/0000689 A1* 1/2012 Shu et al. ..... 174/59
2012/0077392 A1* 3/2012 Thompson et al. ..... 439/889

* cited by examiner

CONTACT RAIL FOR A JUNCTION BOX

BACKGROUND OF THE INVENTION

The subject matter described herein relates generally to a solar junction box and, more particularly, to a contact rail for a solar junction box.

Solar junction boxes are utilized to transfer power from solar modules to an electrical device, for example, an inverter/combiner box and/or other solar modules arranged in a daisy chain. The solar junction box includes contact rails that direct power through the junction box. A module coupling end of each contact rail is configured to connect to a contact of the solar module. A mating end of at least one of the contact rails is configured to connect to a cable and/or contact of the electrical device. A rail cover is positioned over the contact rails to enable the module coupling end to connect to the contact of the solar module. Specifically, the rail cover provides a pivot member for an elongated tool that is utilized to connect a module coupling fastener to the contact of the solar module. The module coupling fastener is pulled back with the elongated tool so that the contact of the solar module can be inserted between the module coupling fastener and a base of the module coupling end. Axial diodes extend over the rail cover and between the contact rails to direct the power from the solar module to the electrical device.

However, conventional solar junction boxes are not without disadvantages. In particular, the rail cover complicates the process of assembling the solar junction boxes. The diodes include contacts that are configured to attach to the contact rails. The contacts must be attached through holes formed in the rail cover. Passing the contacts through the holes to couple them to the contact rail complicates the assembly process of the solar junction box. Complicating the assembly process may increase the time and costs associated with assembling the junction box. The rail cover also complicates the process of replacing diodes and other components of the solar junction box. In particular, the rail cover may have to be removed to replace some components.

Additionally, the rail cover may become disengaged from the solar junction box, when the contact of the solar module is inserted between the module coupling fastener and the base of the contact rail. Specifically, the elongated tool is configured to move the module coupling fastener to create a gap for the contact of the solar module between the module coupling fastener and the base of the contact rail. The elongated tool pivots about the rail cover to move the module coupling fastener. Pressure on the rail cover from pivoting the elongated tool may cause the rail cover to become displaced from the solar junction box.

Moreover, conventional solar junction boxes require the contact rails to be individually coupled thereto. The diodes are then coupled to the contact rails after the contact rails have been positioned within the junction box. Individually coupling the contact rails and diodes increases the time required to assemble the solar junction box.

A need remains for a solar junction box that does snot require a rail cover for assembly. Another need remains for a contact rail assembly that can be pre-assembled before being inserted into a junction box.

SUMMARY OF THE INVENTION

In one embodiment, a contact rail configured to be inserted into a junction box is provided. The contact rail includes a module coupling end and a mating end. A diode mounting surface is positioned between the module coupling end and the mating end. The module coupling end has a base configured to receive a contact from a power module. A pivot member extends from the base of the module coupling end. The pivot member is configured to be engaged by an elongated tool. A module coupling fastener is joined to the module coupling end. The module coupling fastener is movable between a resting position and an open position. The module coupling fastener abuts the base of the module coupling end in the resting position. The module coupling fastener is separated from the base of the module coupling end in the open position to form a gap configured to receive the contact of the power module. The module coupling fastener is configured to receive the elongated tool to move the module coupling fastener from the resting position to the open position. The pivot member is configured to support the elongated tool as the module coupling fastener is moved from the resting position to the open position.

In another embodiment, a contact rail assembly configured to be inserted into a junction box is provided. The assembly includes a first contact rail having a module coupling end and a mating end. A diode mounting surface is positioned between the module coupling end and the mating end. The module coupling end has a base configured to receive a contact from a power module. A second contact rail is provided having a module coupling end and a mating end. A diode mounting surface is positioned between the module coupling end and the mating end. The module coupling end has a base configured to receive a contact from a power module. The mating end has a base configured to receive a contact from an electrically powered device. A diode is coupled between the first contact rail and the second contact rail. The diode has leads and a heat sink surface. The heat sink surface is mounted to the diode mounting surface of one of the first and second contact rails and the leads are mounted to the diode mounting surface of the other of the first and second contact rails.

BRIEF DESCRIPTION OF THE DRAWINGS

FIG. 4(*b*) is another expanded cross-sectional view of the area 4 shown in FIG. 3.

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1A:
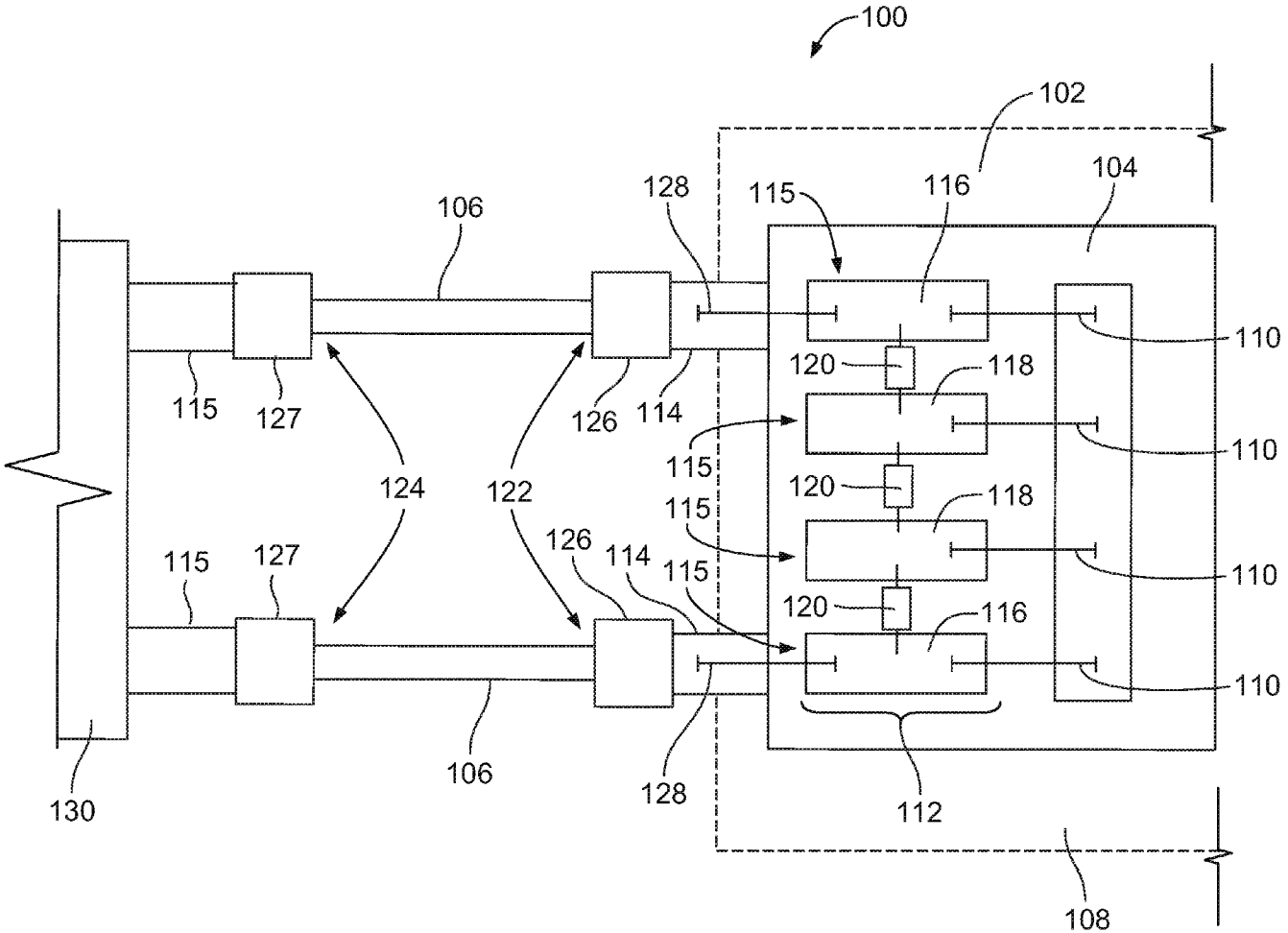
FIG. 1*a* is a schematic view of a power assembly formed in accordance with an embodiment.
Figure 1B:
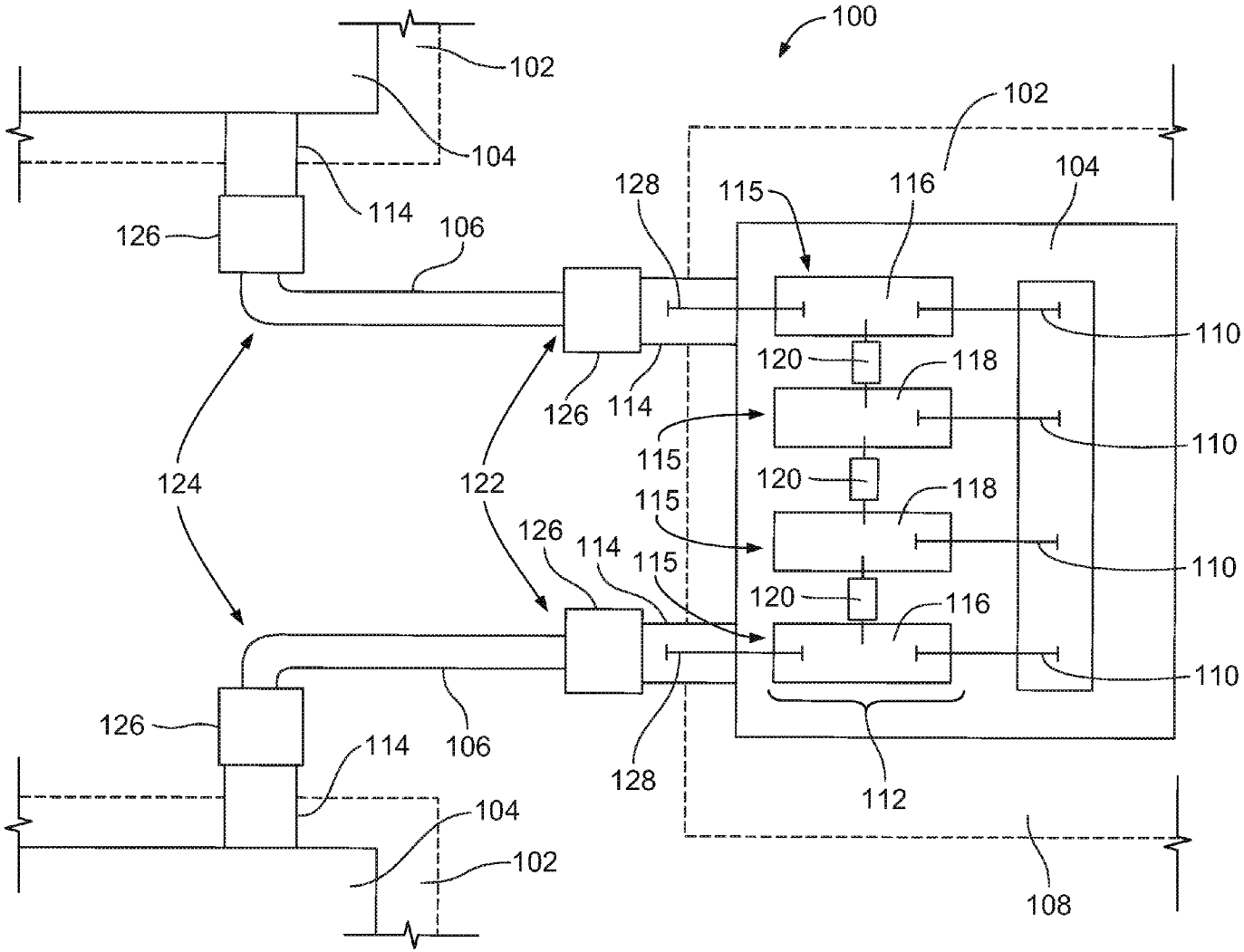
FIG. 1*b* is a schematic view of a power assembly formed in accordance with another embodiment.

FIG. 1*a* illustrates a power assembly 100 formed in accordance with an embodiment. FIG. 1*b* illustrates the power assembly 100 formed in accordance with another embodiment. The power assembly 100 includes a power module 102 coupled to a junction box 104. A cable 106 is joined to the junction box 104. The power module 102 may be a solar panel, a flexible solar substrate, and/or any other device capable of producing energy to form an electrical current. The power module 102 includes a front face 108 that is configured to capture solar energy. The power module 102 also includes electrical leads 110 that direct the energy captured by the front face 108 to the junction box 104. The electrical leads 110 may be formed as a foil sheet. Alternatively, the electrical leads 110 may be formed as any conductive lead capable of channeling energy as an electrical current.

The junction box 104 includes a contact rail assembly 112 that is configured to receive the electrical current from the power module 102. The junction box 104 also includes output connectors 114 that direct the electrical current to the cable 106. The contact rail assembly 112 includes contact rails 115. The contact rails 115 include outer contact rails 116 and inner contact rails 118. The outer contact rails 116 are aligned with the output connectors 114. Alternatively, the inner contact rails 118 may be aligned with the output connectors 114. Each of the contact rails 115 connects to an electrical lead 110 extending from the power module 102. Diodes 120 are positioned between adjacent contact rails 115. The diodes 120 electrically engage the adjacent contact rails 115. The 120 regulate a voltage of the electrical current from the power module 102.

The cable 106 includes a connector end 122 and a device end 124. The connector end 122 is joined to a connector 126 that engages the output connectors 114 of the junction box 104. Contact pins 128 extend from the connector 126. The contact pins 128 are received through the output connectors 114 and are engaged to the outer contact rails 116. Alternatively, a wire of the cable 106 may be received through the output connectors 114 and be engaged to the outer contact rails 116. In an embodiment where the output connectors 114 are aligned with the inner contact rails 118, the contact pins 128 may engage the inner contact rails 118. The outer contact rails 116 direct the electrical current from the power module 102 to the cable 106.

FIG. 1*a* illustrates the cable 106 carrying the electrical current from the power module 102 to an electrical device 130, for example an inverter/combiner box. The electrical device 130 includes connectors 115 that are configured to receive a connector 127 of the cable 106. Alternatively, a wire of the cable 106 may be directly joined to the electrical device 130. In one embodiment, the power assembly 100 does not include the cable 106 and the power module 102 is joined directly to the electrical device 130. Alternatively, the junction box 104 is joined directly to the electrical device 130. In such an embodiment, the contact pins 128 may extend directly from the electrical device 130.

FIG. 1*b* illustrates the cables 106 joined other power modules 102 having junction boxes 104. The other power modules 102 include connectors 114 that are configured to receive a connector 126 of the device end 124 of the cable 106. Alternatively, a wire of the cable 106 may be directly joined to the other power modules 102. In one embodiment, the power assembly 100 does not include the cable 106 and the power module 102 is joined directly to the other power modules 102.

Figure 2:
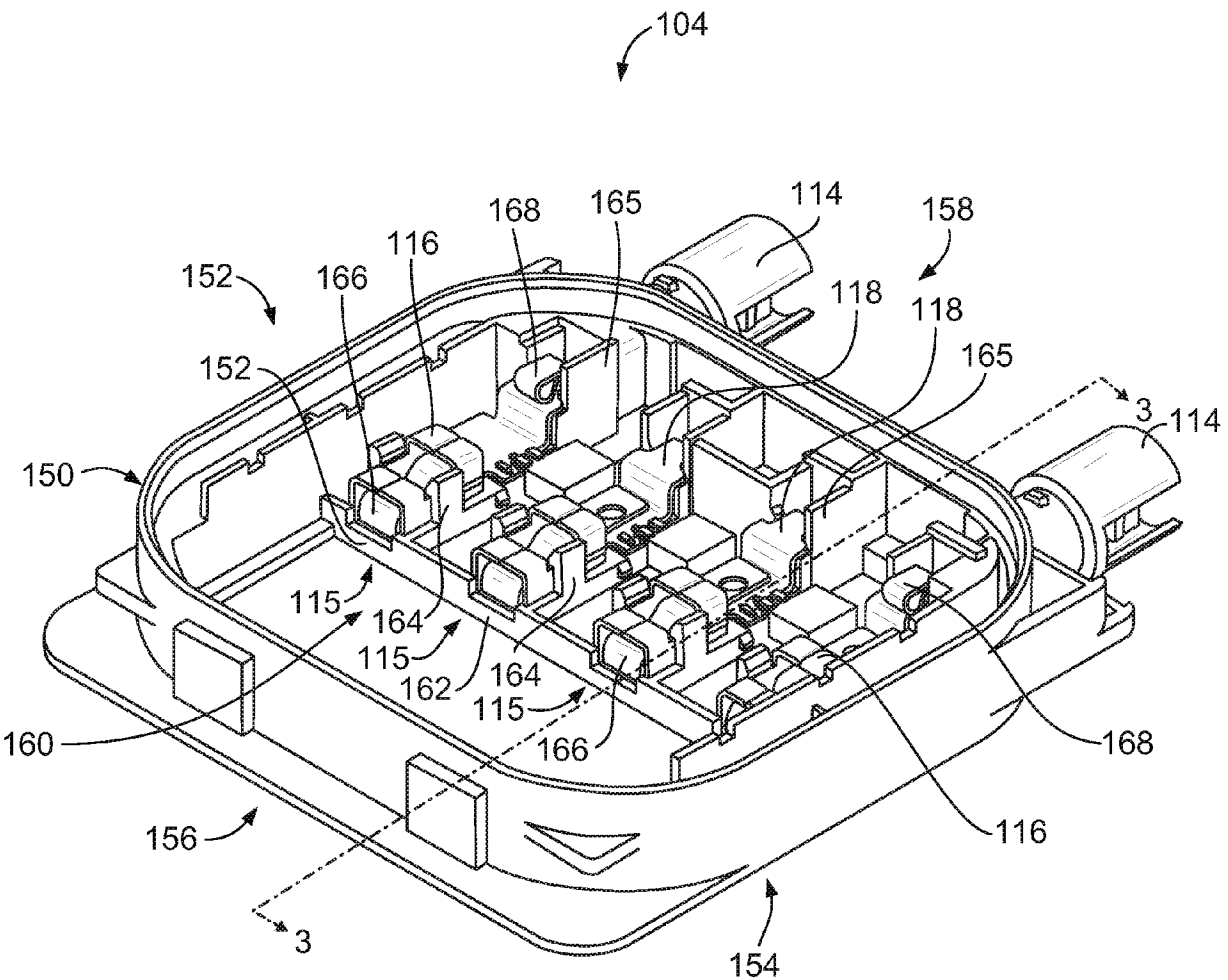
FIG. 2 is a top perspective view of a junction box formed in accordance with an embodiment.

FIG. 2 illustrates a top perspective view of the junction box 104 with the cover removed. The junction box 104 includes a housing 150 having a topside 152 and a bottom side 154. The housing 150 includes a coupling end 156 and a mating end 158. An opening 160 is formed through the bottom side 154 of the housing 150 adjacent to the coupling end 156. The output connectors 114 extend from the mating end 158. The power module 102 is configured to join to the bottom side 154 of the housing 150. The electrical leads 110 of the power module 102 are configured to extend through the opening 160 formed in the bottom side 154 of the housing 150.

The housing 150 also includes rail surfaces 162. The contact rails 115 or the contact rail assembly 112 are mounted on the rail surfaces 162. Latches 164 are positioned adjacent to the rail surfaces 162 and configured to lock to the contact rails 115. Latches 165 are positioned proximate to the mating end 158 of the housing 150 and are configured to lock to the contact rails 115. The latches 164 retain the contact rail assembly 112 within the junction box 104. Alternatively, the contact rails 115 may be bonded to the rail surfaces 162. In another embodiment, the contact rails 115 may be joined to the rail surfaces 162 with a snap-fit configuration. The diodes 120 extend between adjacent contact rails 115.

The contact rails 115 include a module coupling fastener 166. The module coupling fasteners 166 are configured to connect to the electrical leads 110 extending from the power module 102. The module coupling fasteners 166 are illustrated as a spring clip. Alternatively, the module coupling fasteners 166 may be any fastener capable of connecting with the electrical leads 110. The outer contact tails 116 also include a contact fastener 168. The contact fastener 168 is aligned with one of the output connectors 114. The contact fastener 168 is configured to connect to one of the contact pins 128 extending from the connector 126. Alternatively, the inner contact rails 118 may be aligned with the output connectors 114 of the junction box 104. In such an embodiment, the inner contact rails 118 may include a contact fastener 168.

The contact rail assembly 112 may be pre-assembled prior to being inserted into the junction box 104. The contact rails 115 are formed with the respective module coupling fasteners 166 and contact fasteners 168. The contact rails 115 are then aligned so that the diodes 120 are surface mountable between the adjacent contact rails 115. The contact rail assembly 112 is then inserted into the junction box 104 as single unit. The latches 164 and 165 retain the contact rail assembly 112 within the junction box 104 so that the electrical leads 110 of the power module 102 and the contact pins 128 of the connector 126 may be joined to the respective contact rail 115.

Figure 3:
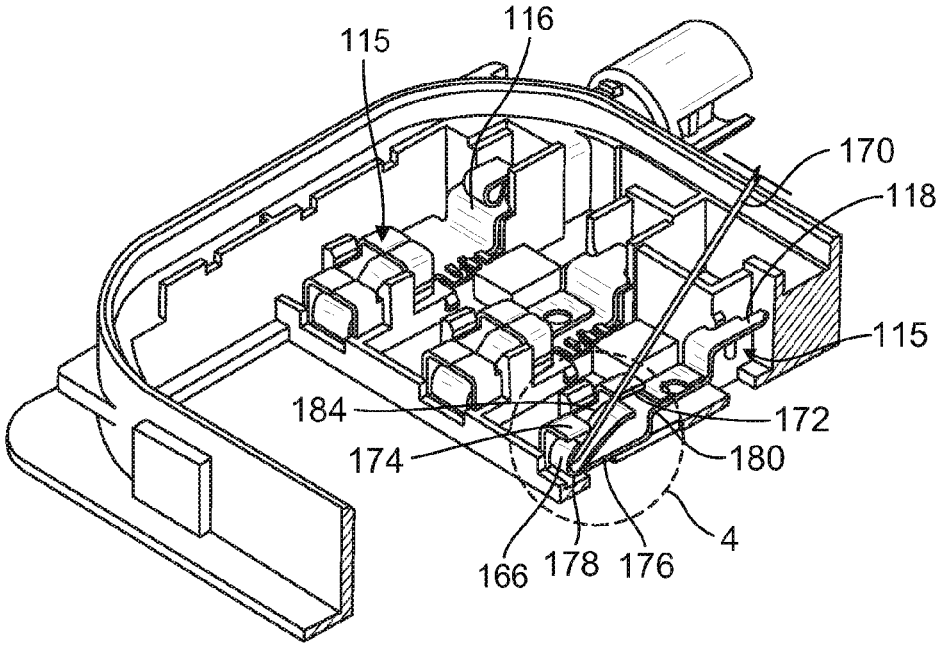
FIG. 3 is a top perspective view of the junction box shown in FIG. 2 and having a cutout taken along the line 3-3 shown in FIG. 2.

FIG. 3 is a side perspective cutaway view of the junction box 104 taken along the line 3-3 of FIG. 2. The contact rails 115 are configured to receive an elongated tool 170. The elongated tool 170 displaces the module coupling fastener 166. The contact rail 115 includes a base 176, a pivot member 172, and a stopping member 174. The pivot member 172 and the stopping member 174 are formed as flanges. An opening 184 extends between the stopping member 174 and the pivot member 172. The module coupling fastener 166 includes a contact end 178 positioned proximate to the stopping member 174. The module coupling fastener 166 includes a support end 180 positioned proximate to the pivot member 172. The contact end 178 of the module coupling fastener 166 is located between the base 176 of the contact rail 115 and the stopping member 174. The support end 180 of the module coupling fastener 166 is positioned between the base 176 of the contact rail 115 and the pivot member 172. The support end 180 is coupled to the contact rail 115. The contact end 178 is configured to rest on the base 176 of the contact rail 115 in a resting position 151 (shown in FIG. 4(*a*)). The contact end 178 of the module coupling fastener 166 is configured to be engaged by the elongated tool 170.

The elongated tool 170 is inserted through the opening 184 formed between the pivot member 172 and the stopping member 174. The elongated tool 170 is configured to pivot about the pivot member 172 so that the contact end 178 of the module coupling fastener 166 is moved into an open position 153 (shown in FIG. 4(*b*)), wherein the contact end 178 of the module coupling fastener 166 is disengaged from the base 176 of the contact rail 115. The contact end 178 is moved toward the stopping member 174 of the contact rail 115. The stopping member 174 prevents over-displacement of the module coupling fastener 166. The module coupling fastener 166 engages the stopping member 174 so that the module coupling fastener 166 is incapable of being displaced further than the stopping member 174. The stopping member 174 prevents the module coupling fastener 166 from becoming deformed during the displacement from the base 176 of the contact rail 115.

Figure 4A:
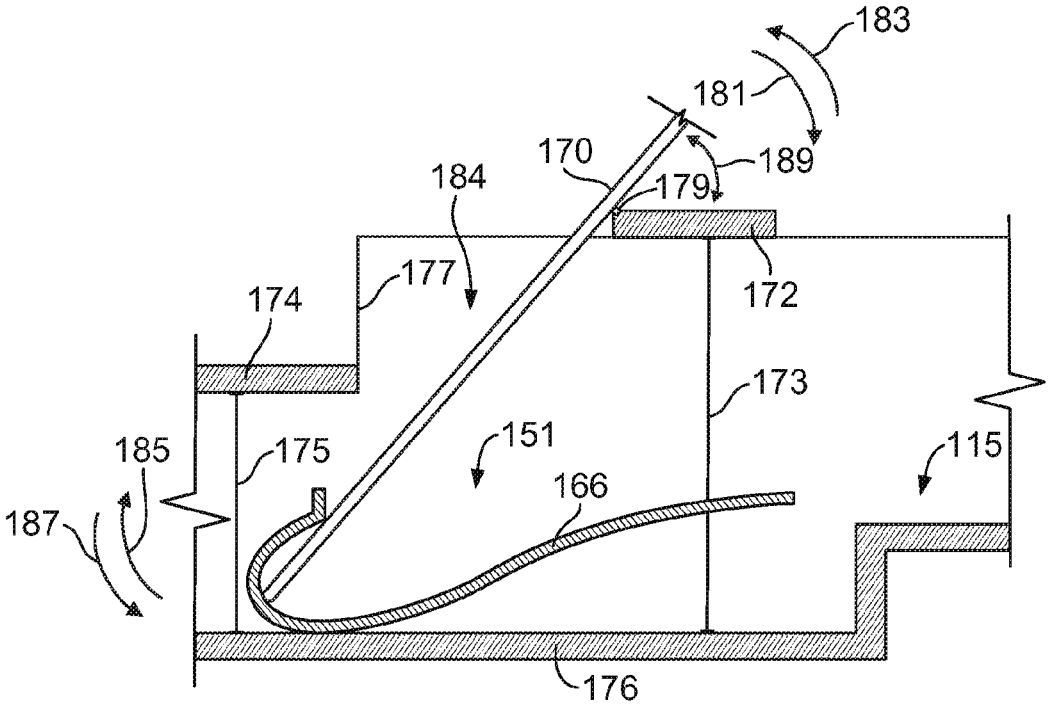
FIG. 4(*a*) is an expanded cross-sectional view of the area 4 shown in FIG. 3.
Figure 4B:
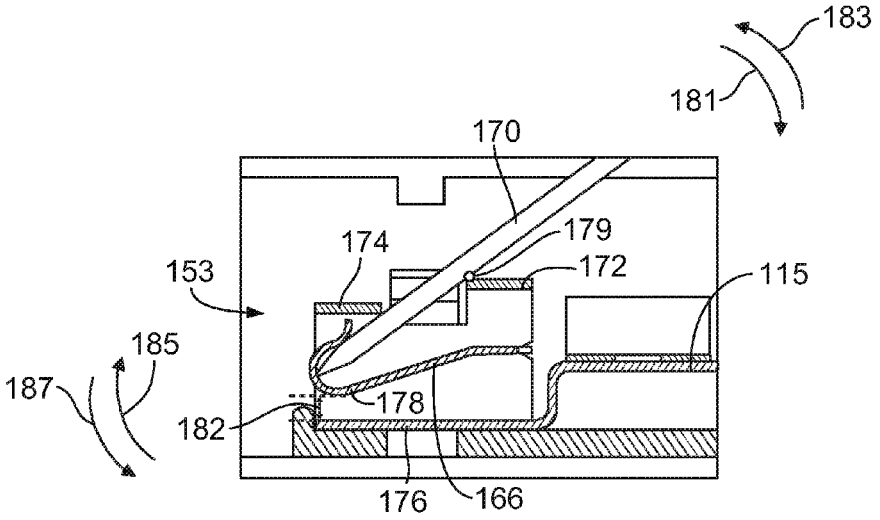

FIG. 4(*a*) is an exploded cross-sectional view of the area 4, shown in FIG. 3. FIG. 4(*a*) illustrates the module coupling fastener 166 is a resting position 151. The pivot member 172 and the stopping member 174 are positioned in stepped-down configuration. The pivot member 172 is positioned a distance 173 from the base 176 of the contact rail 115. The stopping member 174 is positioned a distance 175 from the base 176 of the contact rail 115. The distance 173 is greater than the distance 175. Alternatively, the distance 175 may be greater than the distance 173. The stopping member 174 is stepped down a distance 177 from the pivot member 172. In another embodiment, the pivot member 172 may be stepped down from the stopping member 174.

The module coupling fastener 166 is in a resting position 151. The module coupling fastener 166 rest on the base 176 of the contact rail. The elongated tool 170 is inserted through the opening 184 formed between the pivot member 172 and the stopping member 174. The elongated tool 170 rests on the pivot member 172. The elongated tool 170 is oriented at an angle 189 with respect to the pivot member 172. A pivot point 179 is provided on the pivot member 172 at the location where the elongated tool 170 engages the pivot member 172. The elongated tool 170 pivots about the pivot point in the direction of arrows 181 and 183. The elongated tool 170 pivots in the direction 181 to move the module coupling fastener 166 out of the resting position 151. The module coupling fastener 166 is configured to move in the direction 185 out of the resting position 151. The module coupling fastener 166 moves in the direction 185 toward the stopping member 174. The elongated tool 170 pivots in the direction 183 to move the module coupling fastener 166 back into the resting position 151. The module coupling fastener 166 moves in a direction 187 back into the resting position 151. The module coupling fastener 166 moves in the direction 187 away from the stopping member 174.

FIG. 4(*b*) is an exploded cross-sectional view of the area 4, shown in FIG. 3. FIG. 4(*b*) illustrates the module coupling fastener 166 in an open position 153. The elongated tool 170 is rotated about the pivot point 179 of the pivot member 172 in the direction 181 to move the module coupling fastener 166 in the direction 185. The module coupling fastener 166 is moved in the direction 185 away from the base 176 of the contact rail 115. The module coupling fastener 166 is moved toward the stopping point 174. In the illustrated embodiment, the module coupling fastener 166 is moved into contact with the stopping point 174. The contact end 178 of the module coupling fastener 166 is displaced from the base 176 of the contact rail 115 to create a gap 182 between the contact end 178 of the module coupling fastener 166 and the base 176 of the contact rail 115. The gap 182 is configured to receive an electrical lead 110 of the power module 102.

The electrical lead 110 is configured to be placed within the gap 182. The elongated tool 170 is then rotated in the direction 183 to move the module coupling fastener 166 in the direction 187. The module coupling fastener 166 moves back into the rested position 151 (shown in FIG. 4(*a*)). The electrical lead 110 is retained between the contact end 178 of the module coupling fastener 166 and the base 176 of the contact rail 115 when the module coupling fastener 166 is in the resting position 151. In another embodiment, the elongated tool 170 is removed from the contact rail 115. When the elongated tool 170 is removed, the module coupling fastener 166 springs in the direction 187 back into the resting position 151.

Figure 5:
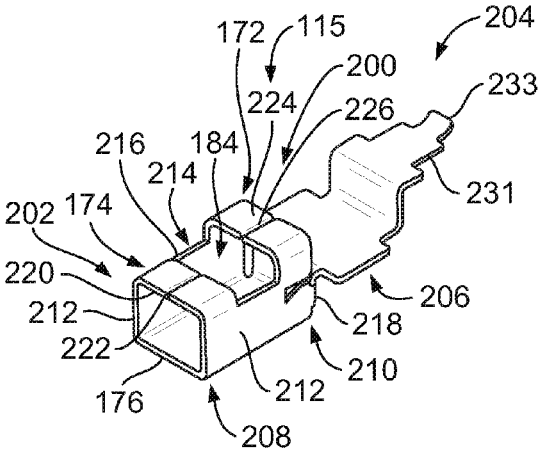
FIG. 5 is a top perspective view of a contact rail, formed in accordance with an embodiment.

FIG. 5 illustrates a contact rail 115. The contact rail 115 includes a body 200 having a module coupling end 202 and a mating end 204. A diode mounting surface 206 extends between the module coupling end 202 and the mating end 204. The module coupling end 202 is configured to receive an electrical contact 110 from the power module 102. The module coupling end 202 includes a front end 208 and a back end 210. The base 176 extends between the front end 208 and the back end 210. Opposing sides 212 extend from the base 176. In the illustrated embodiment, the sides 212 extend substantially orthogonally from the base 176 and substantially parallel to one another. Alternatively, the sides 212 may extend at any angle from the base 176. The sides 212 may also extend at angles with respect to one another.

A top 214 of each side 212 forms an engagement surface 216. The engagement surface 214 is configured to receive a latch 164 of the junction box 104 when the contact rail 115 is positioned within the junction box 104. Alternatively, the sides 212 may include protrusions, notches, grooves, or the like that engage corresponding features in the junction box 104. Both engagement surfaces 214 of the contact rain 115 may be engaged by a latch 164 of the junction box 104. Optionally, only one of the engagement surfaces 214 of the contact rail 115 may be engaged by a latch 164.

Each side 212 also includes a slot 218. The slot 218 is configured to receive and retain the support end 180 of the module coupling fastener 166. The slot 218 may retain a tab formed on the support end 180 of the module coupling fastener 166. Alternatively, the support end 180 of the module coupling fastener 166 may be soldered to or bonded to the sides 212. In another embodiment, the sides 212 include notches, grooves, tabs, or the like that engage a corresponding mechanism formed on the support end 180 of the module counting fastener 166.

A flange 220 extends from the front end 208 of each side 212. Each flange 220 includes an end 222. The flanges 220 are bent toward one another to form the stopping member 174. The flanges 220 are bent toward one another so that the ends 222 of each flange 220 are positioned adjacent to one another. The flanges 220 are bent substantially orthogonally relative to the corresponding side 212. The flanges 220 are oriented substantially parallel to the base 176 of the contact rail 115. Optionally, the flanges 220 may be bent at any angle with respect to the sides 212 and/or the base 176.

A flange 224 extends from the back end 210 of each side 212. The flange 224 may be formed above the slot 218 formed in the side 212. Alternatively, the flange 224 may be formed at any position on the back end 210 of the side 212. Each flange 224 includes an end 226. The flanges 224 are bent toward one another to form the pivot member 172. The flanges 224 are bent toward one another so that the ends 226 of each flange 224 are positioned adjacent to one another. The flanges 224 are bent substantially orthogonally relative to the corresponding side 212. The flanges 224 are oriented substantially parallel to the base 176 of the contact rail 115. Optionally, the flanges 224 may be bent at any angle with respect to the sides 242 and/or the base 176. The opening 184 extends between the pivot member 172 and the stopping member 174.

The module coupling end 202 is configured to receive the module coupling fastener 166. The module coupling fastener 166 is positioned between the sides 212 and extends between the front end 208 and the back end 210 of the module coupling end 202. The support end 180 of the module coupling fastener 166 is retained within the slots 218 and the contact end 178 of the module coupling fastener 166 rests on the base 176 of the module coupling end 202. The opening 184 between the pivot member 172 and the stopping member 174 is configured to receive the elongated tool 170 so that the contact end 178 of the module coupling fastener 166 can be displaced from the base 176 of the module coupling end 202. The electrical lead 110 of the power module 102 is received and retained between the base 176 of the module coupling end 202 an the contact end 178 of the module coupling fastener 166.

The diode mounting surface 206 extends from the back end 210 of the module coupling end 202. The diodes 120 are configured to be mounted on the diode mounting surface 206. The diodes 120 may be surface mounted to the diode mounting surface 206. In one embodiment, the diodes 120 are soldered to the diode mounting surface 206. Optionally, the diodes 120 may be press-fit or otherwise retained on the diode mounting surface 206. The diodes 120 are configured to position between adjacent contact rails 115. A first contact from a diode 120 is mounted en the diode mounting surface 206 of a contact rail 115 and a second contact from the diode 120 mounts to the diode mounting surface 206 of an adjacent contact rail 115.

The mating end 204 of the contact rail 115 may be configured to connect to a contact pin 128 of the connector 126. For example, FIGS. 1 and 2 illustrate outer contact rails 116 configured to connect to a contact pin 128. Alternatively, the inner contact rails 118 may be configured to connect to a contact pin 128. The mating end 204 of the contact rail includes a base 231 and a tab 233 extending from the base 231. The base 231 and/or the tab 233 may be connected to the contact pin 128. Tab 233 may include a contact fastener 168 coupled thereto. The contact fastener 168 is configured to engage the contact pin 128 of the connector 126 with the base 231 and/or the tab 233 of the mating end 204.

Figure 6:
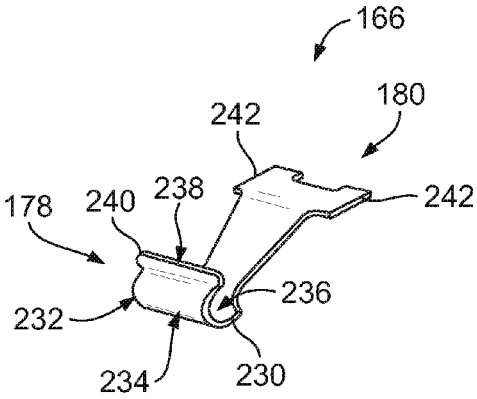
FIG. 6 is a top perspective view of a module coupling fastener formed in accordance with an embodiment.

FIG. 6 illustrates a module coupling fastener 166. The module coupling fastener 166 is configured to be inserted into the module coupling end 202 of the contact rail 115. The module coupling fastener 166 includes the contact end 178 and the support end 180. The contact end 178 includes a contact surface 230 and a tool engaging flange 232. The contact surface 230 is configured to engage the base 176 of the contact rail 115. The electrical lead 110 of the power module 102 is configured to be retained between the contact surface 230 of the module coupling fastener 166 and the base 176 of the module coupling end 202 of the contact rail 115.

The tool engaging flange 232 is configured to be engaged by the elongated tool 170. The tool engaging flange 232 includes a convex side 234 and a concave side 236. The concave side 236 forms a tool receiving cavity 238. Alternatively, the tool engaging flange 232 can have any shape that forms a tool receiving cavity 238. The tool receiving cavity 238 receives an end of the elongated tool 170. When the elongated tool 170 is pivoted on the pivot member 172, the elongated tool 170 engages the tool receiving cavity 238 to move the module coupling fastener 166 and create the gap 182 between the contact surface 230 of the module coupling fastener 166 and the base 176 of the contact rail 115. A stopping flange 240 extends from the tool engaging flange 232. When the module coupling fastener 166 is moved by the elongated tool 170, the stopping flange 240 is moved into engagement with the stopping member 174 of the contact rail 115 to prevent the module coupling fastener 166 from becoming deformed.

The support end 180 of the module coupling flange 166 includes alignment tabs 242. The alignment tabs 242 are configured to be received within the slots 218 formed in the back end 210 of the contact rail 115. The slots 218 are configured to retain the module coupling fastener 166 within the contact rail 115. In one embodiment, the alignment tabs 242 are frictionally retained within the slots 218. Optionally, the alignment tabs 242 may be soldered to the slots 218 and/or retained with a coupling mechanism, for example, a notch, a latch, a press-fit mechanism, or the like. In one embodiment, the contact rail 115 does not include the slots 218 and the support end 180 of the module coupling flange 166 is otherwise joined to the sides 212 of the contact rail 115.

Figure 7:
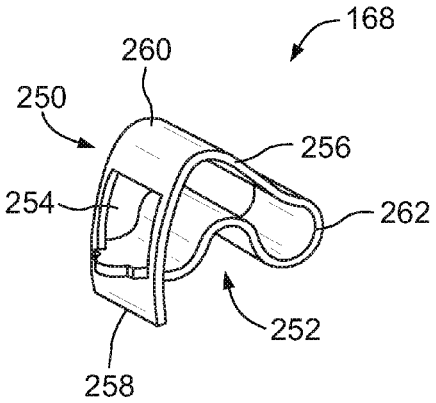
FIG. 7 is a top perspective view of a contact fastener formed in accordance with an embodiment.

FIG. 7 illustrates a contact fastener 168. The contact fastener 168 is configured to connect to one of the contact pins 128 extending from the connector 126. The contact fastener 168 is configured to couple to the mating end 204 of the contact rail 115. The contact fastener 168 includes a coupling end 250 and a contact end 252. A hinged portion 256 extends between the coupling end 250 and the contact end 252. The coupling end 250 includes an opening 254 that receives the tab 233 of the mating end 204 of the contact rail 115. The contact end 252 of the contact fastener 168 extends through the opening 254 and retains the tab 233 of the contact rail 115 between the contact end 252 of the fastener 168 and a bottom portion 258 of the coupling end 250 of the contact fastener 168.

The contact pin 128 of the connector 126 is joined to the base 231 of the mating end 204 of the contact tail 115 by the contact fastener 168. Force is applied to a top 260 of the coupling end 250 of the contact listener 168 to open the contact fastener 168. The force causes the hinged portion 256 of the contact fastener 168 to rotate about a hinge 262 formed between the hinged portion 256 and the contact end 252. The coupling end 250 is moved so that the contact end 252 is separated from the bottom portion 258 of the coupling end 250. The contact pin 128 is inserted through the opening 254 between the contact end 252 and the bottom portion 258 of the coupling end 250. When the force is removed, the contact pin 128 is pinched between the bottom portion 258 of the coupling end 250 and the contact end 252. The contact pin 128 is retained by the contact fastener 168 against the mating end 204 of the contact rail 115. In one embodiment, the contact pin 128 is retained against and electrically coupled to the tab 233 of the end 204 of the contact rail 115. Alternatively, the contact pin 128 may be retained against and electrically coupled to the base 231 of the mating end 204 of the contact rail 115.

Figure 8:
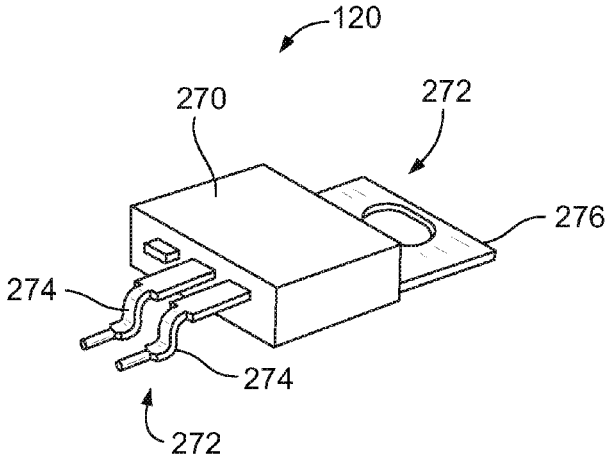
FIG. 8 is a top perspective view of a diode formed in accordance with an embodiment.

FIG. 8 illustrates a diode 120. The diode 120 includes a diode module 270. The diode module 270 includes electrical components configured to regulate a voltage of the electrical current from the power module 102. The diode module 270 is configured to position between adjacent contact rail 115. The diode module 270 is surface mounted to each of the adjacent contact rails 115. Terminals 272 extend from opposing sides of the diode module 270. The terminals 272 include leads 274 and a heat sink surface 276. The leads 274 and the heat sink surface 276 extend from opposite sides of the diode module 270. The illustrated embodiment includes a pair of leads 274 and a single heat sink surface 276. Alternatively, the diode 120 may include any suitable number of leads 274 and mounting plates 276.

The heat sink surface 276 is configured to be mounted to a first contact rail 115. The leads 274 are configured to be coupled to a second contact rail 115 that is positioned adjacent to the first contact rail 115. The electrical current from the power module 102 is directed between the contact rails 115 across the diode 120. The diode 120 is configured to control a voltage of the electrical current directed between the first contact rail 115 and the second contact rail 115.

Figure 9:
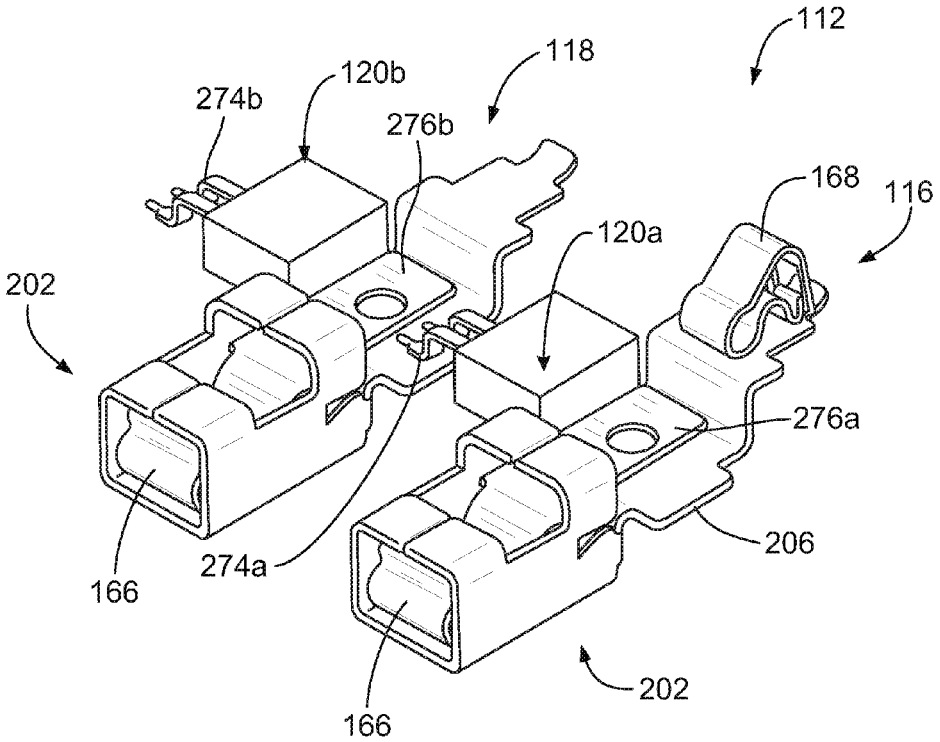
FIG. 9 is a top perspective view of a contact rain assembly formed in accordance with an embodiment.

FIG. 9 illustrates a portion of the contact rail assembly 112. FIG. 9 illustrates an outer contact rail 116 and an inner contact rail 118. Each contact rail 116 and 118 includes module coupling flange 166 configured to receive electrical lead 110 of the power module 102. The outer contact rail 116 also includes a contact fastener 168 that is configured to receive a contact pin 128 of the connector 126. Alternatively, the inner contact rail 118 may be configured with a contact fastener 168 that receives the contact pin 128 of the connector 126. The inner contact rail 118 and the outer contact rail 118 are configured to receive an electrical current from the power module 102. The electrical current is directed through the electrical lead 110 to the module coupling end 202 of the inner contact rail 118 and the outer contract rail 116. The outer contract rail 116 directs the electrical current through the mating end 204 of the outer contact rail 116 to an electrical device 130.

A first diode 120(*a*) is mounted between the inner contact rail 118 and the outer contact rail 118. The heat sink surface 276(*a*) of the first diode 120(*a*) is surface mounted to the outer contact rail 116 and the leads 274(*a*) of the first diode 120(*a*) are surface mounted to the inner contact rail 118. Alternatively, the heat sink surface 276(*a*) of the first diode 120(*a*) may be mounted to the inner contact rail 118 and the leads 274(*a*) of the first diode 120(*a*) may be mounted to the outer contract rail 116. The heat sink surface 276(*a*) and the leads 274(*a*) may be soldered to the diode mounting surface 206 of the respective contact rail 116 and 118. Optionally, the heat sink surface 276(*a*) and the leads 274(*a*) may be bonded, press-fit, or otherwise joined to the diode mounting surface 206 of the respective contact rail 116 and 118. A second diode 120(*b*) is joined to the inner contact rail 118. The heat sink surface 276(*b*) of the second diode 120(*b*) is surface mounted to the inner contact rail 118. The leads 274(*b*) are configured to mount to another contact rail 115, for example, an inner contact rail 118 or an outer contact rail 116. Optionally, the leads 274(*b*) of the second diode 120(*b*) may surface mounted to the inner contact rail 118 and the heat sink surface 276(*b*) may be configured to mount to another contact rail 115.

During assembly of the contact rail assembly 112, each contact rail 115 is pre-loaded. The inner contact rails 118 are loaded with a module coupling fastener 166. The outer contact rails 116 are loaded with both a module coupling fastener 166 and a contact fastener 168. The contact rails 115 are then placed into a fixture. The fixture aligns the contact rails 115. The fixture also spaces the contact rails 115 so that the contact rail assembly 112 can be positioned within the junction box 104. The diodes 120 are then surface mounted between adjacent contact rails 115. The heat sink surface 276 of the diode 120 is coupled to one of the contact rails 115 and the leads 274 of the diode are mounted to the adjacent contact rail 115. The entire contact rail assembly 112 is then positioned within the junction box 104 and retained with the latches 164.

The electrical leads 110 of the power module 102 are inserted through the opening 160 in the junction box 104 and joined to the contact rails 115 with the module coupling fasteners 166. The connector 126 is joined to the junction box 104 so that the contact pins 128 of the connector 126 extend through the output connectors 114 of the junction box 104. The contact pins 128 of the connector 126 are joined to the outer contact rails 116. The contact pins 128 are received by the contact fasteners 168 of the outer contact rails 116 to electrically join the power module 102 and the electrical device 130.

The embodiments described herein provide a junction box that does not require a rail cover. Rather, the embodiments described herein utilize a pivot member formed on the contact rail to couple the junction box to a power module. The embodiments described herein also utilize surface mounted diodes. Accordingly, the embodiments described herein provide a junction box that requires fewer components for assembly. Having fewer components decreases time and costs associated with assembling and maintaining the junction box. Additionally, the embodiments described herein provide a contact rail assembly that can be pre-assembled prior to being inserted within the junction box. Pre-assembling the contact rail assembly further reduces time and costs associated with assembly and maintenance.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase, "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A contact rail configured to be inserted into a junction box, the contact rail comprising:

a metal body extending between a module coupling end and a mating end, the metal body includes a diode mounting surface positioned between the module coupling end and the mating end, the module coupling end having a base configured to receive a contact from a power module;

a diode surface mounted to the diode mounting surface of the metal body, the diode and metal body being configured to be inserted into the junction box as a unit;

a pivot member extending from the base of the module coupling end, the pivot member configured to be engaged by an elongated tool; and a module coupling fastener joined to the module coupling end, the module coupling fastener movable between a resting position and an open position, the module coupling fastener abutting the base of the module coupling end in the resting position, the module coupling fastener separated from the base of the module coupling end in the open position to form a gap configured to receive the contact of the power module, the module coupling fastener configured to receive the elongated tool to move the module coupling fastener from the resting position to the open position, the pivot member configured to support the elongated tool as the module coupling fastener is moved from the resting position to the open position.

2. The contact rail of claim 1, wherein the module coupling fastener is configured to return to the resting position when the elongated tool is removed from the module coupling fastener.

3. The contact rail of claim 1, wherein the module coupling end further comprises a front end and a back end, the pivot member extending from the back end, a stopping member extending from the front end, an opening formed between the pivot member and the stopping member, the opening configured to receive the elongated tool.

4. The contact rail of claim 1 further comprising a stopping member extending from the module coupling end, the stopping member configured to prevent deformation of the module coupling fastener when the module coupling fastener is moved into the open position.

5. The contact rail of claim 1, wherein the module coupling end comprises a pair of opposite sides extending from the base, the pivot member comprising a pair of flanges, each flange extending from one of the opposite sides, the flanges bent toward one another to form the pivot member.

6. The contact rail of claim 1, wherein the module coupling end comprises a side extending from the base, a slot formed in the side, the module coupling fastener comprising an attachment flange that is received within the slot to join the module coupling fastener to the module coupling end.

7. The contact rail of claim 1, wherein the module coupling end comprises an engagement surface, the engagement surface configured to be engaged by a latch formed in the junction box to retain the contact rail within the junction box.

8. The contact rail of claim 1, the diode having leads and a heat sink surface, the heat sink surface mounted to the diode mounting surface of a first contact rail and the leads mounted to the diode mounting surface of a second contact rail positioned adjacent to the first contact rail.

9. The contact rail of claim 1, wherein the mating end has a base, a contact fastener coupled to the base, the contact fastener configured to connect to a contact of an electrically powered device.

10. A contact rail assembly configured to be inserted into a junction box, said assembly comprising:

a first contact rail having a metal body extending between a module coupling end and a mating end, the metal body includes a diode mounting surface positioned between the module coupling end and the mating end, the module coupling end having a base configured to receive a contact from a power module, the first contact rail having a pivot member extending from the base of the module coupling end, the pivot member configured to be engaged by an elongated tool, and the first contact rail having a module coupling fastener joined to the module coupling end and configured to receive the contact of the power module between the base and the modular coupling end, the module coupling fastener movable between a resting position and an open position, the module coupling fastener configured to receive the elongated tool to move the module coupling fastener from the resting position to the open position, the pivot member configured to support the elongated tool as the module coupling fastener is moved from the resting position to the open position;

a second contact rail having a metal body extending between a module coupling end and a mating end, the metal body of the second contact rail includes a diode mounting surface positioned between the module coupling end and the mating end, the module coupling end having a base configured to receive a contact from a power module; the mating end having a base configured to receive a contact from an electrically powered device, the second contact rail having a pivot member extending from the base of the module coupling end, the pivot member configured to be engaged by an elongated tool, and the second contact rail having a module coupling fastener joined to the module coupling end and configured to receive the contract of the power module between the base and the modular coupling end, the module coupling fastener movable between a resting position and an open position, the module coupling fastener configured to receive the elongated tool to move the module coupling fastener from the resting position to the open position, the pivot member configured to support the elongated tool as the module coupling fastener is moved from the resting position to the open position; and a diode coupled between the first contact rail and the second contact rail, the diode having leads and a heat sink surface, the heat sink surface mounted to the diode mounting surface of the metal body of one of the first and second contact rails and the leads mounted to the diode mounting surface of the metal body of the other of the first and second contact rails, the diode and first and second contact rails being configured to be inserted into the junction box as a unit.

11. The contact rail assembly of claim 10, wherein the second contact rail is configured to align with a cable connector of the junction box.

12. The contact rail assembly of claim 10, wherein the mating end of the second contact rail includes a contact fastener coupled to the base, the contact fastener configured to couple to the contact of the electrically powered device.

13. The contact rail assembly of claim 10, wherein the module coupling end of at least one of the first and second contact rails comprises an engagement surface, the engagement surface configured to be engaged by a latch formed in the junction box to retain the contact rail assembly within the junction box.

14. The contact rail assembly of claim 10, wherein the module coupling fasteners are configured to return to the resting position when the elongated tool is removed from the module coupling fastener.

15. The contact rail assembly of claim 10, wherein the module coupling end of at least one of the first and second contact rails includes a front end and a back end, the corresponding pivot member extending from the back end, a flange extending from the front end, an opening formed between the pivot member and the flange, the opening configured to receive the elongated tool.

16. The contact rail assembly of claim 10, wherein at least one of the first and second contact rails includes a stopping member extending from the module coupling end, the stopping member configured to prevent deformation of the module coupling fastener when the module coupling fastener is moved into the open position.

17. The contact rail assembly of claim 10, wherein the module coupling end of at least one of the first and second contact rails comprises a pair of opposite sides extending from the base, the pivot member extending from the module coupling end, the pivot member comprising a pair of flanges, each flange extending from one of the opposite sides, the flanges bent toward one another to form the pivot member.

18. The contact rail assembly of claim 10, wherein the module coupling end of at least one of the first and second contact rails comprises a side extending from the base, a slot formed in the side, the module coupling fastener positioned adjacent to the side, the module coupling fastener comprising an attachment flange that is received within the slot to join the module coupling fastener to the module coupling end.

* * * * *